US005207155A

United States Patent [19]

Thompson

[11] Patent Number: 5,207,155

[45] Date of Patent: May 4, 1993

[54] APPARATUS FOR PRINTING MATTER ONTO OBJECTS

[76] Inventor: Harry Thompson, 14 Cleworth Close, Astley, Manchester, M29 7JF, England

[21] Appl. No.: 911,668

[22] Filed: Jul. 8, 1992

Related U.S. Application Data

[63] Continuation of Ser. No. 825,915, Jan. 27, 1992, abandoned, which is a continuation of Ser. No. 485,624, Feb. 27, 1990, abandoned.

[51] Int. Cl.[5] ..... B41F 17/00

[52] U.S. Cl. ..... 101/35; 101/44; 101/4

[58] Field of Search ..... 101/4, 5, 35, 38.1, 101/39, 40, 40.1, 41, 43, 44, 36, 37

[56] References Cited

U.S. PATENT DOCUMENTS 3,330,402 7/1967 Schlueter ..... 101/35

3,738,260 6/1973 Navi et al. ..... 101/35

4,078,483 3/1978 Gall ..... 101/44

FOREIGN PATENT DOCUMENTS 1251856 11/1971 United Kingdom .

*Primary Examiner*—Edgar S. Burr

*Assistant Examiner*—Christopher A. Bennett

*Attorney, Agent, or Firm*—Pearson & Pearson

[57] ABSTRACT

Objects (11) for example canned goods are carried by a conveyor (1) towards a support device which is formed by spaced runs of two drive belts (2, 3). The objects (11) are deflected off the conveyor (1) by an oblique section (7) of the run of one belt (2) and are gripped between the runs (12, 14) of the two belts (2, 3). When the belts (2, 3) are driven the objects (11) are transported over a printing head (5) which applies matter to the underside. The objects (11) are directed back onto the conveyor (1) by a deflector rail (6) and a further oblique section (8) of the one belt (2).

6 Claims, 1 Drawing Sheet

APPARATUS FOR PRINTING MATTER ONTO OBJECTS

This application is a continuation of application Ser. No. 07/825,915, filed Jan. 27, 1992, now abandoned which is a continuation of application Ser. No. 07/485,624, filed Feb. 27, 1990, now abandoned.

FIELD OF THE INVENTION

This invention related to an apparatus for printing matter onto objects and more particularly to an apparatus for printing onto the underside of objects.

BACKGROUND OF THE INVENTION

It is known to print code numbers unobtrusively on the underside of objects such as canned goods using apparatus comprising fixed, spaced apart guide rails bridging a gap between two aligned conveyor belts. Objects slide along the guide rails pushed by further objects leaving the first conveyor belt and a printing head is moved up and down between the guide rails to apply the code numbers.

With this known arrangement it may be difficult conveniently to achieve rapid, accurate printing insofar as the objects are not moved in a carefully controlled manner during the printing operation.

An object of the present invention is to provide simple apparatus with which it is possible to achieve carefully controlled movement of an object over a printing head.

SUMMARY OF THE INVENTION

According to the invention therefore there is provided apparatus for printing matter onto objects comprising a conveyor for transporting said objects support device arranged to receive said objects and support same spaced from the conveyor, and a printing device for applying printed matter to said supported objects, characterised in that there is provided a first guide, device operable to direct said objects sideways off said conveyor to said support device, said support device is operable to drive said objects over said printing device, and there is provided a second guide device operable to direct said objects sideways from said support device back onto said conveyor.

The support device preferably comprises opposed spaced apart drive belts between which the objects can be gripped. Each drive belt may be driven by means of rotatable rollers. The drive belts may have runs which are parallel to each other defining a path along which the objects are guided and which is preferably parallel to the path of movement of the conveyor. A first said drive belt may also be arranged with a run extending across the conveyor so that such run forms the said first guide device.

In a particularly preferred embodiment, said first drive belt has two runs extending obliquely across the conveyor and two straight parallel runs thereby defining a trapezoidal arrangement.

The said second guide device may comprise a deflector rail or plate or the like.

The said drive belts may bee adjustable to accommodate objects of different dimensions.

DESCRIPTION OF THE DRAWINGS

The invention will now be described further by way of example only and with reference to the accompanying drawing which is a diagrammatic plan view of one form of apparatus according to the invention.

The apparatus comprises a driven conveyor 1 having a horizontal run and a support device formed by two drive belts 2 and 3 and a printing head 5.

Figure 1:
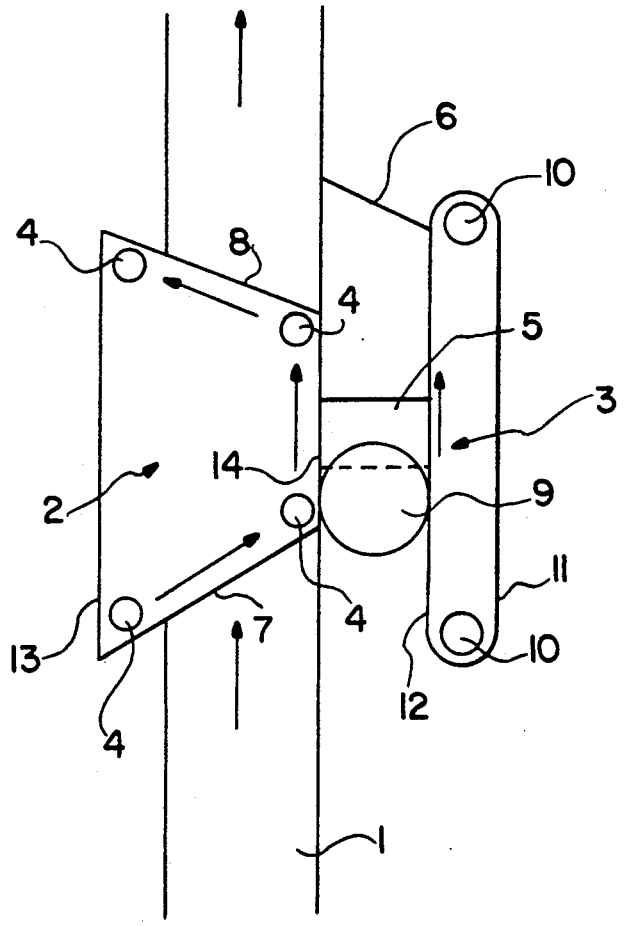

One drive belt 3 is arranged in a trapezoidal configuration around four vertical rollers 4, one of which is drivably connected to a d.c. shunt wound motor (not shown). The belt has two parallel runs 13 and 14, one of which is vertically aligned with one edge of the conveyor run and two inclined runs 7 and 8, one of which is inclined in the direction of movement of the conveyor towards the trailing edge of the runs and the other of which is inclined in the direction of movement away from the leading edge of the run. The other drive belt 3 is arranged around two vertical rotatable rollers 10, one of which is drivably connected to another d.c. shunt wound motor (not shown). The belt 3 has two parallel runs 11 and 12, one of which is parallel to and spaced from the run 14 and arranged at one side of the conveyor, so that a horizontal path is defined between the runs 12 and 14 alongside the conveyor 1. It should be noted that the positioning of belts 2 and 3 can be changed so that the distance between belt runs 12 and 14 can be varied to accommodate objects of different dimensions and sizes.

The printing device comprises a printing head 5 which can be moved up and down beneath the path between the runs 12 and 14 by means of an automatic mechanism (not shown).

An inclined deflector rail 6 extends from a position adjacent to the leading end of the run 12 of the belt 3 towards the conveyor 1 in front of the belt 2.

In use, objects such as canned goods, aerosol spray cans or the like are delivered to the conveyor in upright disposition at regularly spaced intervals.

As the objects reach the trailing inclined run 7 of the belt 2, they are deflected sideways off the conveyor 1 to be gripped between the runs 12 and 14 of the belts 2 and 3 and thereby transported, still at regularly spaced intervals, along the path between the runs. The gripped objects move over the printing head 5 and such head is actuated to move the head up and apply printed matter, such as a code number, to the underside of each object 9.

On reaching the end of the path between the runs 12 and 14, the objects are deflected by the rail 6 back on to the conveyor 1, the positioning of the belts 2 and 3 and the rail 6 relative to the conveyor 1 being such that the objects are re-deposited on the conveyor 1 just as they leave the grip of the belts 2 and 3.

In this way it is possible for objects to be moved in a carefully controlled manner over a printing head and thus it is possible for accurate, rapid printing onto these objects to be achieved.

The movement of the printing head 5 and the advancement of the belts 2 and 3 can by synchronised to ensure accurate printing, if necessary by arresting the advancement at the instant of engagement with the printing head.

The speed of rotation of the driven rotatable rollers controlling the drive belts is adjustable by changing the current to the d.c. motor using a potentiometer. This enables the apparatus to be used in conjunction with existing conveyor lines, the drive speed being adjusted to match the line speed. Thus the belts 2 and 3 and the printing head 5 with associated control equipment can form a separate unit which is free standing or attached to the conveyor as appropriate.

The one drive belt 2 can be adjusted clear of the conveyor belt 1 when not in use.

It is of course to be understood that the invention is not intended to be restricted to the details of the above embodiment which are described by way of example only.

I claim:

1. Apparatus for printing matter onto objects comprising a conveyor for transporting said objects, a support device arranged to receive said objects, and support same spaced from the conveyor, said objects having a bottom surface thereto, and a printing device for applying printed matter to said bottom surface of said supported objects, said apparatus including a first guide device operable to positively drive said objects sideways off said conveyor to said support device said support device being operable to drive said objects over said printing device, said apparatus further including a second guide device operable to positively drive said objects sideways from said support device back onto said conveyor, wherein said support device comprises opposed spaced apart drive belts between which said objects can be gripped so as to be supported stably, and a first said drive belt comprises a run extending across said conveyor so that such run forms the said first guide device.

2. Apparatus according to claim 1, wherein each said drive belt is driven by means of rotatable rollers.

3. Apparatus according to claim 1, wherein said drive belts have runs which are parallel to each other defining a first path along which the objects are guided.

4. Apparatus according to claim 3, wherein said conveyor extends along a second path and said first path and said second path are substantially parallel.

5. Apparatus according to claim 1, wherein said second guide device comprises a deflector rail.

6. Apparatus for printing matter onto objects comprising a conveyor for transporting said objects, a support device arranged to receive said objects and support same spaced from the conveyor, said objects having a bottom surface thereto, and a printing device for applying printed matter to said bottom surface of said supported objects, said apparatus including a first guide device operable to positively drive said objects sideways off said conveyor to said support device, said support device being operable to drive said objects over said printing device, said apparatus further including a second guide device operable to positively drive said objects sideways from said support device back onto said conveyor, wherein said support device comprises opposed spaced apart drive belts between which said objects can be gripped so as to be supported stably, and said first drive belt has two runs extending obliquely across said conveyor and two straight parallel runs thereby defining a trapezoidal arrangement.

* * * * *

UNITED STATES PATENT AND TRADEMARK OFFICE

CERTIFICATE OF CORRECTION

PATENT NO. : 5,207,155

DATED : May 4, 1993

INVENTOR(S) : Harry Thomason

It is certified that error appears in the above-identified patent and that said Letters Patent is hereby corrected as shown below:

Column 1, name of the inventor, change "Thompson" to -- Thomason --

Signed and Sealed this

Twenty-fifth Day of January, 1994

*Attest:*

*Attesting Officer*

BRUCE LEHMAN

*Commissioner of Patents and Trademarks*